US005192236A

United States Patent [19]

Nakamura

[11] Patent Number: 5,192,236

[45] Date of Patent: Mar. 9, 1993

[54] LUBRICATING DEVICE FOR OUTBOARD MOTOR

[75] Inventor: Kazuhiro Nakamura, Hamamatsu, Japan

[73] Assignee: Sanshin Kogyo Kabushiki Kaisha, Shizuoka, Japan

[21] Appl. No.: 507,970

[22] Filed: Apr. 11, 1990

[30] Foreign Application Priority Data

Apr. 13, 1989 [JP] Japan ..... 1-91867

[51] Int. Cl.[5] ..... B63H 5/12

[52] U.S. Cl. ..... 440/88; 440/1

[58] Field of Search ..... 440/88, 1, 53

[56] References Cited

U.S. PATENT DOCUMENTS 4,708,674 11/1987 Matsumoto ..... 440/88

*Primary Examiner*—Joseph F. Peters, Jr.
*Assistant Examiner*—Thomas J. Brahan
*Attorney, Agent, or Firm*—Ernest A. Beutler

[57] ABSTRACT

A lubricant delivery system for an outboard motor that includes a lubricant storage tank positioned in the hull of an associated watercraft and a lubricant delivery tank carried by the outboard motor. A switching arrangement supplies lubricant to the delivery tank when its level falls below a predetermined amount and shuts it off when the lubricant level reaches a predetermined amount. The outboard motor is mounted for trim adjustment and a trim sensing arrangement is incorporated for sensing when a change in the trim of the outboard motor might effect needless actuation of the lubricant pump and cause overfilling of the lubricant delivery tank.

7 Claims, 4 Drawing Sheets

LUBRICATING DEVICE FOR OUTBOARD MOTOR

BACKGROUND OF THE INVENTION

This invention relates to a lubricating device for an outboard motor and more particularly an improved lubricant system for an outboard motor that insures proper operation even in the event that the outboard motor trim is changed.

It is well known that outboard motors frequently employ two cycle internal combustion engines. Although such engines are frequently lubricated by mixing lubricant with the fuel, recently, separate lubricating systems have been proposed wherein lubricant is supplied to the engine from a lubricant tank separate from the fuel tank. Frequently these systems employ a lubricant tank that is mounted directly in the power head of the outboard motor. As is well known, outboard motors are conventionally mounted for tilt and trim adjustment. Obviously, when the trim of the outboard motor is varied, the level of the lubricant in the power head mounted tank will change and this can, unless otherwise compensated for, adversely effect the lubrication system and its function.

It is, therefore, a principal object of this invention to provide an improved lubricating system for an outboard motor having a separate lubricant tank mounted in the power head of the outboard motor.

It is a further object of this invention to provide an improved control for the lubricating system of an outboard motor that is responsive to changes in trim that could adversely effect the operation of the lubrication system.

One very popular type of lubricating system for outboard motors is of the type shown in U.S. Pat. No. 4,572,120, entitled "Separate Lubricating System For Marine Propulsion Device", issued Feb. 25, 1986 and now reissued as RE 32,593. In the system shown in that patent, the lubricant system for the engine includes a large lubricant storage tank that is positioned externally of the outboard motor and which is mounted within the hull of the associated watercraft. This tank supplies fuel to a lubricant delivery tank that is mounted within the power head of the outboard motor and which delivers lubricant to the engine lubricating system. There is provided a float operated switch arrangement in the lubricant delivery tank that controls an electric motor driven pump for maintaining the level of lubricant within the delivery tank between predetermined minimum and maximum levels.

As noted in that patent, however, the trim adjustment of the outboard motor can cause the lubricant level to appear to be lower than it actually is. If the external pump is operated, excess lubricant can be supplied to the tank that will overflow when the trim is returned to normal. This is obviously an undesirable condition and an embodiment of that application discloses a mercury switch that is operative to prevent such overfilling conditions. Such mercury level switches must, however, be adjusted for each type of outboard motor and its pivot arrangement. This is unduly complicated.

It is, therefore, a still further object of this invention to provide an improved arrangement for controlling the operation of a lubricant system to compensate for situations when the trim of the outboard motor is changed sufficiently to require correction of the operation of the lubricating system.

It is a further object of this invention to provide an improved lubricating system that incorporates a trim condition mechanism that controls the lubrication system when the trim condition is changed to one in which the lubricating system requires control.

SUMMARY OF THE INVENTION

This invention is adapted to be embodied in a lubricant delivery system for an outboard motor mounted for trim adjustment on the transom of an associated watercraft. The outboard motor comprises an internal combustion engine and a lubricant system for the engine comprising a lubricant tank carried by the outboard motor and a lubricant pump for pumping lubricant between the tank and another component of the lubricating system. Sensing means are provided for sensing a change in the trim of the outboard motor of sufficient magnitude to effect the operation of the lubricant system and provide an output signal in response to the sensing of such a change. Means are provided for changing the operation of the lubricant pump when the sensing means generates an output signal.

DETAILED DESCRIPTION OF THE PREFERRED EMBODIMENT OF THE INVENTION

Figure 1:
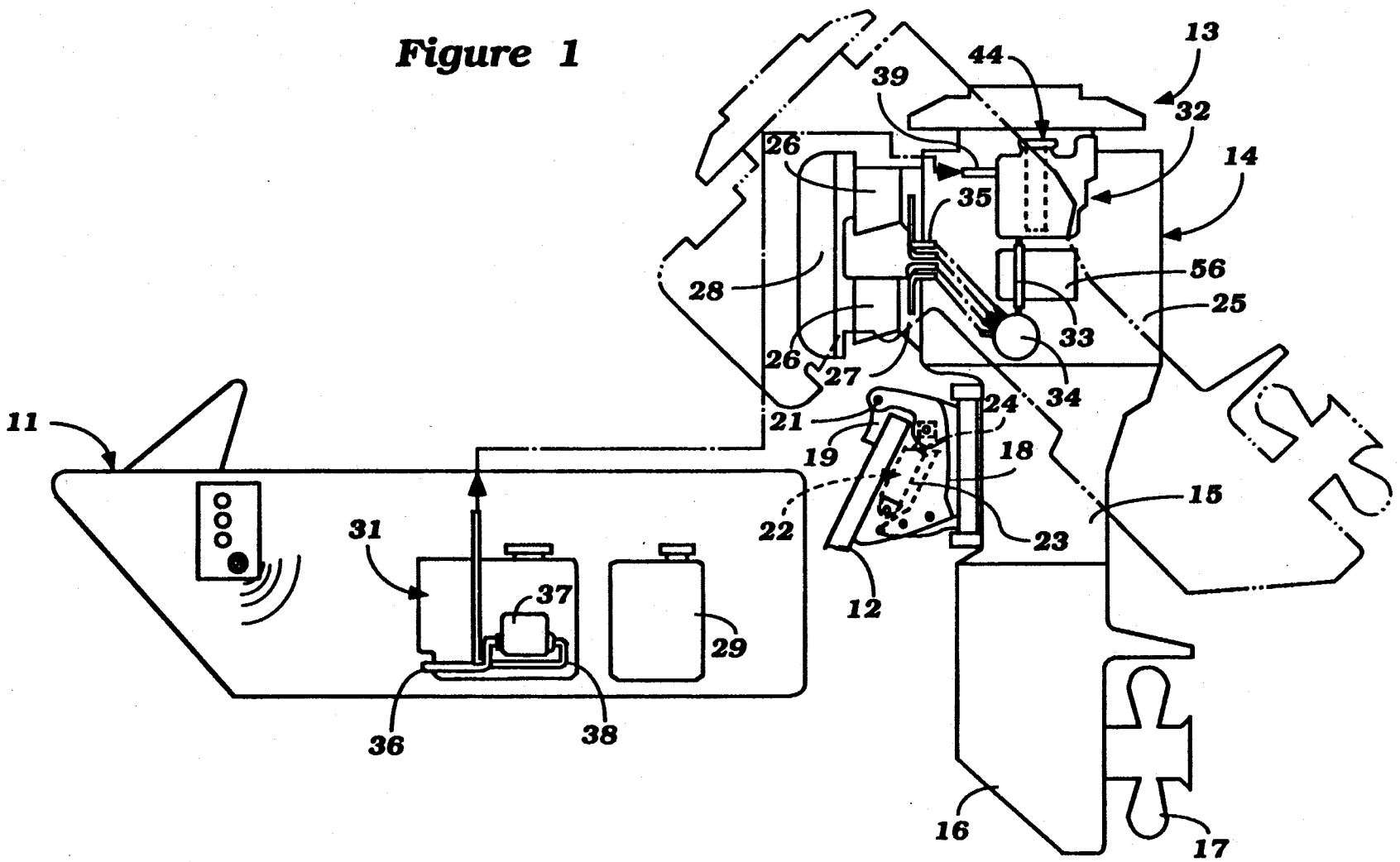
FIG. 1 is a partially schematic side elevational view of a watercraft outboard motor and lubricating system for the outboard motor.

Referring now in detail to the drawings and initially primarily to FIG. 1, a watercraft is depicted schematically at 11 and has a transom 12 to which an outboard motor, indicated generally by the reference numeral 13 is attached. The outboard motor 13 is comprised of a power head consisting of an internal combustion engine 14, which may be of any known type, but which operates on the two stroke crankcase compression principle. It is to be understood, that the invention can be utilized in conjunction with engines operating on other than the two stroke principle. The engine 14, as is typical with outboard motor practice, is supported so that its output or crankshaft rotates about a vertically extending axis.

A drive shaft (not shown) depends from the power head into a drive shaft housing 15 and lower unit 16. A forward, neutral, reverse transmission (not shown) is contained within the lower unit 16 for selectively driving a propeller 17 in forward or reverse directions, as is well known in this art.

A steering shaft (not shown) is affixed to the drive shaft housing 15 and is journaled for steering movement of the outboard motor 13 within a swivel bracket 18. The swivel bracket 18 is, in turn, pivotally connected to a clamping bracket 19 by means of a pivot pin 21 for tilt and trim movement of the outboard motor 13 about a horizontally extending tilt axis defined by the pivot pin 21. The clamping bracket 19 carries a device for affixing the outboard motor 13 detachably to the transom 12.

A hydraulic cylinder assembly, indicated generally by the reference numeral 22 has a cylinder 23 that is pivotally connected to the clamping bracket 19 and a piston rod 24 that is pivotally connected to the swivel bracket 18 for achieving tilt and trim operation of the outboard motor 13. The hydraulic motor 22 is powered in any suitable manner.

The engine 14 includes a cylinder block assembly 25 that defines crankcase chambers to which a fuel/air mixture is delivered from carburetors 26 through a manifold 27. The carburetors 26 draw filtered air from within the protective cowling, which is removed in the drawings to more clearly show the construction, through an intake silencing device 28. Fuel is supplied to the carburetors 27 from a fuel tank 29 that is mounted within the hull of the watercraft 11 through a suitable fuel supply system.

The construction of the outboard motor 13 and its association with the watercraft 11 as thus far described may be considered to be conventional. For that reason, further details of the components thus far described are not believed to be necessary to understand the construction and operation of the invention.

In accordance with the invention, the outboard motor 13 and specifically its internal combustion engine 14 is provided with a separate lubricating system which is comprised of a large capacity lubricant storage tank 31 that is positioned within the hull of the watercraft 11. In addition, there is provided a smaller capacity lubricant delivery tank 32 that is mounted within the power head of the outboard motor 13 and specifically upon the cylinder block 25 in a known manner.

Lubricant is delivered, in response to a control system which will be described, from the storage tank 31 to the delivery tank 32 so as to maintain a predetermined quantity of lubricant in the delivery tank 32. Lubricant then flows from the delivery tank 32 through a conduit 33 to a lubricant pump 34. The lubricant pump 34 is driven by the engine 14 and supplies lubricant to various components of the engine for its lubrication through a plurality of delivery conduits 35. The conduits 35 may include portions that intersect the manifold 27 for spraying lubricant into the intake manifold 27 for lubrication of the components of the engine. In addition, certain of the conduits 35 may extend directly to certain portions of the engine to be lubricated.

There is provided a supply conduit 36 that extends from the lower end of the lubricant storage tank 31 to an electrically driven lubricant transfer pump 37. The transfer pump 37 communicates with a discharge conduit 38 which supplies lubricant through a quick disconnect coupling to an inlet nipple 39 formed in the lubricant delivery tank 32 (FIG. 2).

Figure 2:
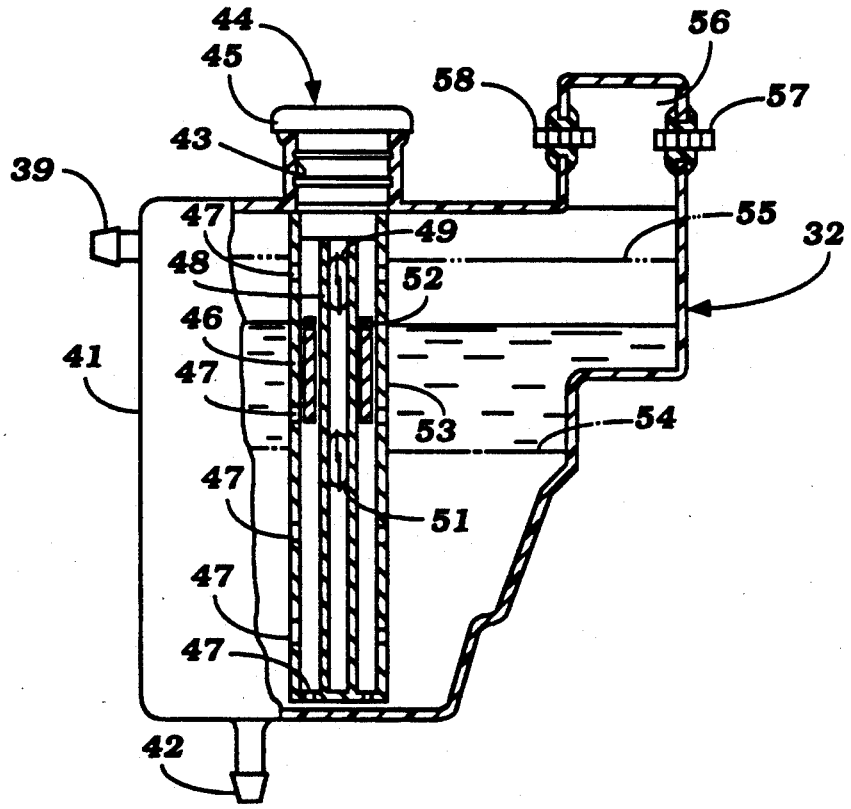
FIG. 2 is an enlarged side elevational view of the lubricant delivery tank, with a portion broken away and shown in phantom.

Referring now in detail to FIG. 2, the lubricant delivery tank 32 has a molded outer body 41 in which the inlet nipple 39 extends. In addition, an outlet nipple 42 extends from the lower portion of the tank 32 to the conduit 33 for supplying the lubricant, as aforenoted, to the lubricating pump 34.

The body 41 has a neck portion 43 in which a combined closure and switch assembly, indicated generally by the reference numeral 44 is positioned. The switch assembly 44 has a closure portion 45 that sealingly engages the opening 43 and which supports a tube 46 that depends into the tank body 41. A plurality of restricted orifices 47 extend through the tube 46 so that lubricant can enter the interior of the tube 46 at a restricted rate. A center tube 48 is contained within the outer tube 46 and carries a high level shut off reed type switch 49 and a low level reed type turn on switch 51. The switches 49 and 51 are of the magnetically operated type and are operated by means of a permanent magnet 52 carried on a cylindrical float 53.

As should be readily apparent, the float 53 will seek its level of the lubricant within the interior of the tube 46. When the magnet 52 is in proximity with the switch 51 and the oil level is at the line 54, the switch 51 will turn on the pump 37 so that lubricant will be delivered from the storage tank 31 to the delivery tank 32. When the lubricant reaches the level 55, the switch 49 will be actuated and the pump 31 will be shut off to prevent overfilling.

The upper portion of the body 41 is provided with an air space 56 and air can be admitted to the air space 56 and tank 32 through an inlet check valve 57 so that a vacuum will not be drawn when the lubricant level is falling. In a like manner, a check valve 58 will permit air to be expelled when lubricant is being delivered to the delivery tank 32. The operation of the pump 37 and specifically the electric motor associated with it is controlled by means of a control box 56 that is mounted on the side of the engine 14 as shown in FIG. 1 and which has a construction as shown in FIG. 3.

Figure 3:
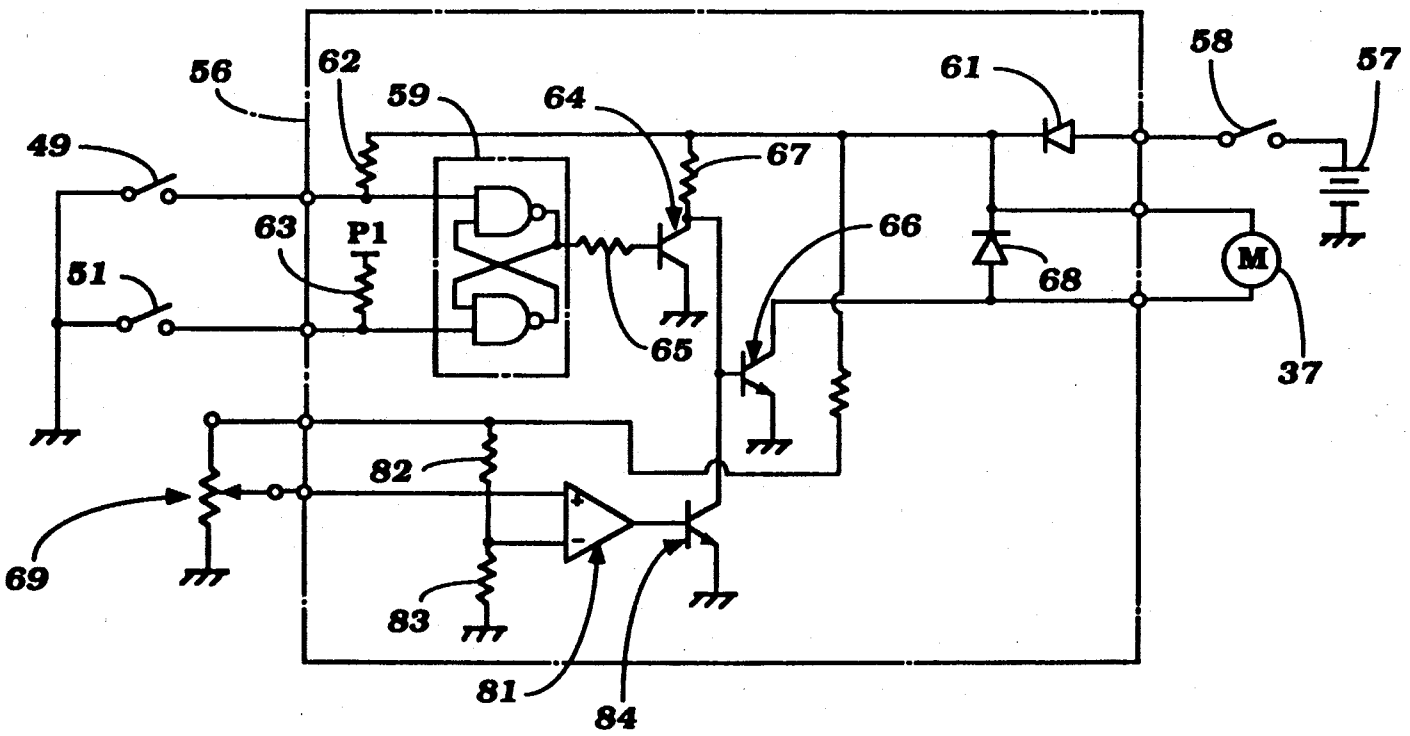
FIG. 3 is a schematic electrical diagram of the lubricant pumping system.

Referring now to FIG. 3, the aforenoted battery, indicated schematically by the reference numeral 57, is in circuit through a main switch 58 through one terminal of a flip flop 59 through a diode 61 and resistor 62. The switch 49 is in this circuit and when closed will change the state of the flip flop 59. In a similar manner, the battery 57 is in circuit through the main switch 58 with a junction P1 in a suitable manner which is in circuit with a resistor 63 and switch 51 for changing the state of the flip flop 59 when the switch 51 is closed.

The flip flop 59 is, in turn, in circuit with the base of an SCR 64 through a resistor 65 for switching the transistor 64 on or off, depending upon the state of the flip flop 59. The SCR 61 switches a further SCR 66 through a circuit including a resistor 67 which SCR 66 controls the circuit to the motor 57. A diode 68 is positioned across the circuit of the pump motor 37.

The operation is that as the liquid level in the delivery tank 32 falls to the level 54 and the switch 51 is activated, the state of the flip flop 59 is changed into a zero voltage state so as to turn the transistor 64 off and change the state of the transistor 66 so as to turn it on and energize the pump motor 37. As the liquid level in the delivery tank 32 rises to the point 55, the switch 49 will be closed and the state of the flip flop 59 will be turned to its positive state and the transistor 64 will be turned on and the transistor 66 turned off to stop the operation of the pump.

Figure 4:
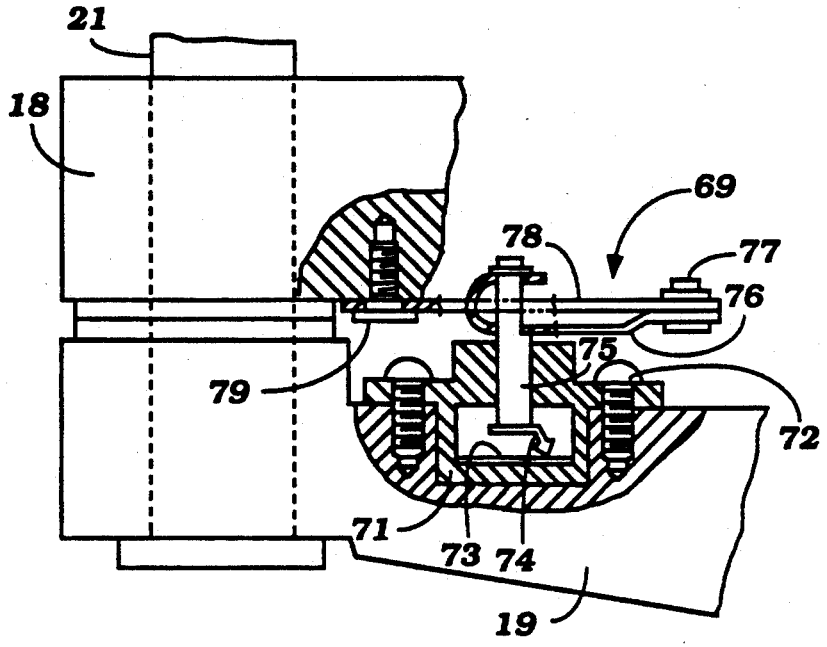
FIG. 4 is an enlarged top plan view, with a portion broken away, showing the trim sensing mechanism.
Figure 5:
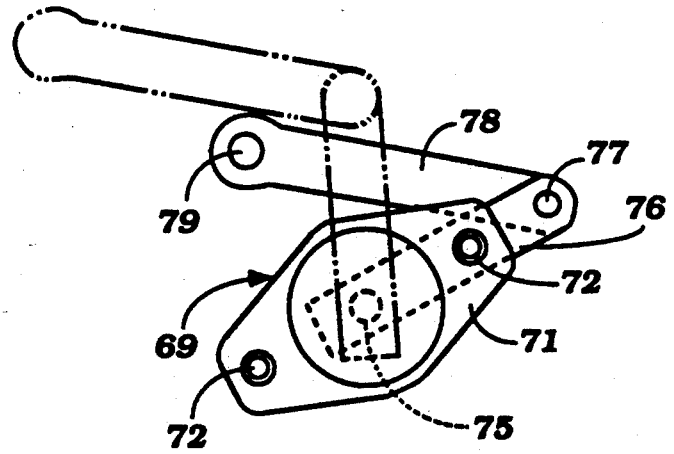
FIG. 5 is a side elevational view of the trim sensing mechanism with the trim at one position being shown in solid lines and the trim in another position being shown in phantom.

It should be readily apparent that changes in the trim that are significant can significantly alter the level of the liquid adjacent the float 53 without changing the total volume of the liquid in the delivery tank 32. If this occurs, and additional liquid is supplied to the delivery tank 32 by the switching of the reed switch 51 on, then the tank 32 will be overfilled and liquid will overflow when the trim of the outboard motor 13 is changed. To avoid this condition, there is provided a trim condition indicator, indicated generally by the reference numeral 69 and shown in most detail in FIG. 4.

The trim position indicator 69 includes a main body portion 71 that has a flange which is secured to the clamping bracket 59 by threaded fasteners 72. Contained within this main body portion 71 is a resistance winding 73 that is contacted by a wiper arm 74. The wiper arm 74 is, in turn, affixed to a shaft 75 that is journaled within the body portion 71 and which is connected to one end of a lever 76. The other end of the lever 76 is connected by means of a pivot pin 77 to one end of a further lever 78. The lever 78 is pivotally connected at its other end by means of a pivot pin 79 to the swivel bracket 18. As a result, when the trim angle is changed, the wiper 74 will change the resistance of the device 69 and provide an output signal to a comparator 81 (FIG. 3) within the control device 56. The other terminal of the comparator 81 receives a fixed voltage signal from a resistor circuit including resistors 82 and 83 so as to provide a constant reference voltage indicative of a position beyond which a change in trim of the outboard motor 13 will effect adversely the liquid level in the delivery tank 32.

When this occurs, the comparator 81 outputs a signal to the base of an SCR or transistor 84 so as to render it conductive and complete a circuit to the ground so that the transistor 66 cannot be switched on even when the switch 51 is closed. As a result, even though the switch 51 may call for the addition of fluid, the comparator 81 will prevent this from occurring because the circuit knows that the addition of fluid is not required.

It should be readily apparent from the foregoing description that the described construction is extremely effective in providing a good lubrication system for the engine and a very simple device which will insure that the delivery tank 32 is not overfilled. This eliminates the need for special tuning of mercury type switches or other devices contained within the power head of the outboard motor 13.

It should be understood that the foregoing description is that of a preferred embodiment of the invention. Various changes and modifications may be made without departing from the spirit and scope of the invention, as defined by the appended claims.

I claim:

1. A lubricant delivery system for an outboard motor mounted for trim adjustment upon the transom of a watercraft hull, said outboard motor comprising an internal combustion engine and a lubricant system for said engine comprising a lubricant tank carried by said outboard motor and a lubricant pump for pumping lubricant between said tank and another component of the lubricating system, sensing means for sensing a change of the trim of said outboard motor of sufficient magnitude to affect operation of said lubricant system and providing an output signal in response to the sensing of a change, and means for changing the operation of said lubricant pump when said sensing means provides an output signal.

2. A lubricant delivery system as set forth in claim 1 wherein the lubricant pump is an on/off device and the sensing means output effects shutting off the lubricant pump.

3. A lubricant delivery system as set forth in claim 2 wherein the sensing means comprises means for sensing the trim position of the outboard motor and comparator means for comparing the sensed position with the predetermined condition that will effect operation of the lubricant system.

4. A lubricant delivery system as set forth in claim 1 wherein the other component of the lubricating system comprises a lubricant storage tank positioned externally of the outboard motor and the lubricant pump transfers lubricant from the lubricant storage tank to the lubricant tank carried by the outboard motor.

5. A lubricant delivery system as set forth in claim 4 further including means for switching on the lubricant pump when the level of liquid in the lubricant tank carried by the outboard motor falls below a predetermined value and switches off the lubricant pump when the level of lubricant exceeds a predetermined value.

6. A lubricant delivery system as set forth in claim 5 wherein the lubricant pump is an on/off device and the sensing means output effects shutting off the lubricant pump.

7. A lubricant delivery system as set forth in claim 6 wherein the sensing means comprises means for sensing the trim position of the outboard motor and comparator means for comparing the sensed position with the predetermined condition that will effect operation of the lubricant system.

* * * * *